US010323444B2

(12) United States Patent
Brombach et al.

(10) Patent No.: US 10,323,444 B2
(45) Date of Patent: Jun. 18, 2019

(54) WINDOW SHORT DROP FOR A VEHICLE WITH AN ELECTRONIC LATCH

(71) Applicant: Ford Global Technologies LLC, Dearborn, MI (US)

(72) Inventors: Ronald Patrick Brombach, Plymouth, MI (US); Howard Paul Tsvi Linden, Southfield, MI (US); John Thomas Ricks, Taylor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 210 days.

(21) Appl. No.: 15/291,317

(22) Filed: Oct. 12, 2016

(65) Prior Publication Data

US 2018/0100332 A1 Apr. 12, 2018

(51) Int. Cl.

| | |
|---|---|
| ***E05F 15/73*** | (2015.01) |
| ***E05B 81/76*** | (2014.01) |
| ***E05F 15/76*** | (2015.01) |

(52) U.S. Cl.

CPC ..... *E05B 81/76* (2013.01); *E05F 15/73* (2015.01); *E05F 15/76* (2015.01); *E05Y 2900/55* (2013.01)

(58) Field of Classification Search

CPC ..... G07C 9/00309; E05F 15/73; E05F 15/76; E05Y 2900/55; E05Y 2900/531; E05B 81/20

USPC ..... 49/31, 280, 360, 362, 279, 29, 30

See application file for complete search history.

(56) References Cited

U.S. PATENT DOCUMENTS

| | | | | |
|---|---|---|---|---|
| 6,246,195 | B1 | 6/2001 | Kloesters | |
| 8,360,505 | B2 * | 1/2013 | Iijima | E05F 15/77 296/155 |
| 8,443,553 | B1 * | 5/2013 | Polewarczyk | E05B 81/77 16/412 |
| 8,708,396 | B2 | 4/2014 | Konchan | |
| 8,827,027 | B2 | 9/2014 | John et al. | |
| 9,855,918 | B1 | 1/2018 | Melaragni et al. | |
| 2002/0108310 | A1 | 8/2002 | Schroer | |

(Continued)

FOREIGN PATENT DOCUMENTS

| | | |
|---|---|---|
| CN | 101280657 A | 10/2008 |
| DE | 19836761 C1 | 7/1999 |

(Continued)

OTHER PUBLICATIONS

Search Report dated Mar. 15, 2018 for GB Patent Application No. 1716090.4 (5 pages).

(Continued)

*Primary Examiner* — Chi Q Nguyen

(74) *Attorney, Agent, or Firm* — Frank Lollo; Neal, Gerber & Eisenberg LLP; James P. Muraff

(57) ABSTRACT

Method and apparatus are disclosed for window short drop for a vehicle with an electronic latch. An example door of a vehicle includes a door control unit communicatively coupled to an electronic latch. The electronic latch, in response to detecting a user touching an exterior handle, requests authorization from the vehicle. In response to receiving authorization, the electronic latch sends a request to the door control unit to lower a window of the door. Additionally, in response to receiving a confirmation from the door control unit, the electronic latch unlatches the door.

16 Claims, 2 Drawing Sheets

(56) References Cited

U.S. PATENT DOCUMENTS

2003/0038733 A1* 2/2003 Willats ..... G07C 9/00182 340/12.22
2008/0047199 A1* 2/2008 Pribisic ..... E05F 15/70 49/31
2009/0033256 A1* 2/2009 Kamiya ..... E05F 15/40 318/366
2009/0229183 A1* 9/2009 Kamiya ..... E05F 15/43 49/28
2010/0237635 A1* 9/2010 Ieda ..... E05B 81/78 292/336.3
2011/0102138 A1 5/2011 Girard et al.
2011/0308162 A1* 12/2011 Kamiya ..... E05B 81/20 49/349
2013/0097940 A1* 4/2013 Brown ..... B60J 5/0473 49/506
2014/0000165 A1* 1/2014 Patel ..... E05B 81/76 49/31
2014/0320260 A1 10/2014 Van Wiemeersch et al.
2015/0021931 A1* 1/2015 Konchan ..... E05B 47/0001 292/194
2015/0191150 A1 7/2015 Van Wiemeersch et al.
2015/0235494 A1 8/2015 Creguer et al.
2015/0314756 A1 11/2015 Moenig et al.
2016/0138321 A1 5/2016 Donald et al.
2016/0167621 A1* 6/2016 Luu ..... E05F 15/73 701/48
2017/0234154 A1* 8/2017 Downs ..... F01D 5/189 415/177

FOREIGN PATENT DOCUMENTS

DE 102005028353 A1 12/2006
FR 2896262 A1 2/2008
JP 2002180744 A 6/2002
WO WO 2011/113911 A1 9/2011
WO WO 2015/103206 A2 7/2015

OTHER PUBLICATIONS

Search Report dated Apr. 30, 2018 for GB Patent Application No. GB 1716090.4 (3 pages).

* cited by examiner

WINDOW SHORT DROP FOR A VEHICLE WITH AN ELECTRONIC LATCH

TECHNICAL FIELD

The present disclosure generally relates to window control for convertible vehicles and, more specifically, window short drop for a vehicle with an electronic latch.

BACKGROUND

Some vehicle doors do not have a frame around the window. Instead, these vehicles a have a channel on the frame of the body of the vehicle or a convertible top of the vehicle to provide a water tight seal and noise reduction to the vehicle cabin. However, when the door is opened, the window drags on the channel and makes a loud, unpleasant noise. Similarly, when the door is closed, it runs into the channel and makes a loud, unpleasant noise.

SUMMARY

The appended claims define this application. The present disclosure summarizes aspects of the embodiments and should not be used to limit the claims. Other implementations are contemplated in accordance with the techniques described herein, as will be apparent to one having ordinary skill in the art upon examination of the following drawings and detailed description, and these implementations are intended to be within the scope of this application.

Example embodiments are disclosed for window short drop for a vehicle with an electronic latch. An example door of a vehicle includes a door control unit communicatively coupled to an electronic latch. The electronic latch, in response to detecting a user touching an exterior handle, requests authorization from the vehicle. In response to receiving authorization, the electronic latch sends a request to the door control unit to lower a window of the door. Additionally, in response to receiving a confirmation from the door control unit, the electronic latch unlatches the door.

An example vehicle includes a door with an electronic latch and a body control unit communicatively coupled to the electronic latch. The example body control module broadcasts a signal via a low frequency transmitter in response to receiving a request for authorization from the electronic latch. The signal to activate key fobs in a vicinity of the vehicle. When one of the key fobs is authorized, the body control module grants the authorization to the electronic latch.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION OF EXAMPLE EMBODIMENTS

Figure 1:
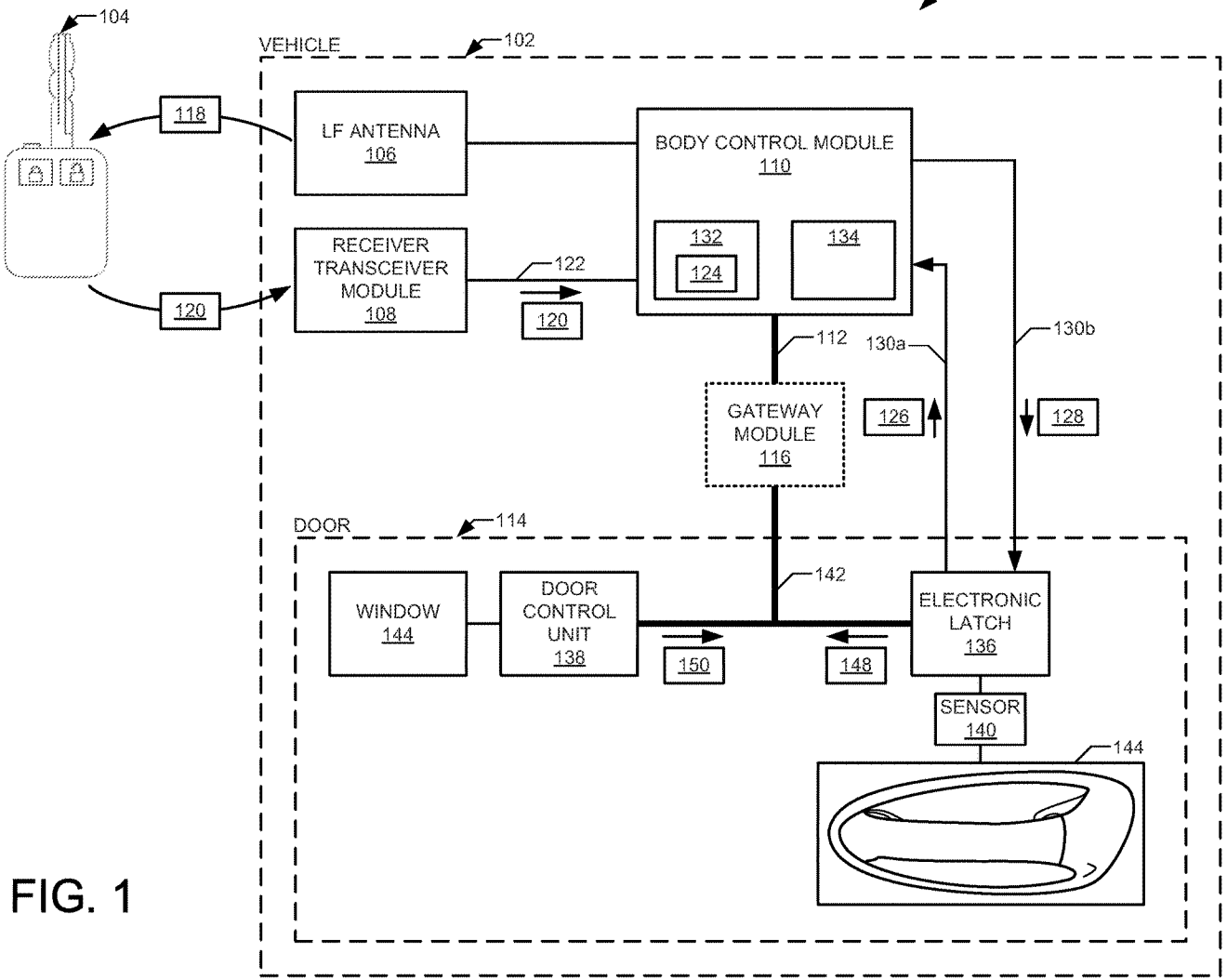
FIG. 1 depicts a block diagram of electronic components of the vehicle and the key fob operating in accordance with the teachings of this disclosure.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

To clear the channel on the frame of the body of the vehicle or a convertible top of the vehicle, the vehicle short drops the windows. As used herein, short dropping the windows refers to lower the windows enough to remove the window from the channel but not enough to clear flexible gasket (e.g., a few millimeters). Currently, vehicle use a door ajar circuit to cause the window to open when the door opens and the window to close when the door closes. However, if the user opens the door quickly, the window may still be moving when the user pulls it open. This causes the unpleasant noise and, over time, can damage the window.

As disclosed herein below, the vehicle with the channel in the body or the convertible top includes a keyless entry system and an electronic latch (sometimes referred to herein as an "elatch"). The elatch is electrically coupled to a body control module via one or more data buses. Additionally, the elatch latches and unlatches (e.g., locks and unlocks) the door of the vehicle based on messages over the bus(es) from the body control module instead of mechanical linkage between the latch and a door handle. As disclosed below, when the elatch detects a user (e.g., via a capacitive and/or infrared sensor on the door handle, etc.), the elatch sends an unlatch request message to the body control unit. When the unlatch request message is received, the body control manager determines whether an authorized key fob is within range of the vehicle. If the authorized key fob is within range of the vehicle, the body control module sends an authorized request message to the elatch. The elatch then sends a short drop request message to a door control unit corresponding to the door handle the user interacted with. Additionally, the elatch unlatches the door in response to receiving a short drop complete message from the door control unit. In such a manner, the door remains locked until the window has cleared the channel.

FIG. 1 depicts a block diagram of electronic components 100 of a vehicle 102 and a key fob 104 operating in accordance with the teachings of this disclosure. The vehicle 102 may be a standard gasoline powered vehicle, a hybrid vehicle, an electric vehicle, a fuel cell vehicle, and/or any other mobility implement type of vehicle. The vehicle 102 includes parts related to mobility, such as a powertrain with an engine, a transmission, a suspension, a driveshaft, and/or wheels, etc. The vehicle 102 may be non-autonomous, semi-autonomous (e.g., some routine motive functions controlled by the vehicle 102), or autonomous (e.g., motive functions are controlled by the vehicle 102 without direct driver input). In the illustrated example the vehicle 102 includes a low-frequency (LF) transmitter 106, a receiver transceiver module 108, a body control module 110, a first vehicle data bus 112, and doors 114. In some examples, the vehicle also includes gateway module 116.

The LF transmitter 106 includes a radio and antenna to transmit a low frequency (e.g., 125 kHz to 130 kHz, etc.)

signal that includes a beacon message 118. In some examples, the LF transmitter 106 is located in one of the the doors 114 (e.g., in the exterior door handle 146 below). A transmitter power of the the LF transmitter 106 is configured so that the beacon message 118 has a range that is relatively close to the vehicle 102 (e.g., 3 feet (1 meter), etc.). The receiver transceiver module 108 includes antenna to receive an authentication message 120 from the key fob 104. The receiver transceiver module 108 is tuned to receive authentication message 120 from the key fob at a medium frequency (e.g., 315 MHz to 902 MHz, etc.). The authentication message 120 includes an authentication token (e.g., an encrypted identifier, an encrypted counter, etc.) to determine whether the key fob 104 is authorized to unlock the vehicle 102.

The body control module 110 controls various subsystems of the vehicle 102. In the illustrated example, the body control module 110 is communicatively coupled, via the first vehicle data bus 112, to the doors 114 to manage (a) locking and unlocking the doors 114 and (b) raising and lowing windows (e.g., the window 144 below). Additionally, the body control module 110 manages the state (e.g., transmitting or asleep) of the LF transmitter 106. The body control module 110 is communicatively coupled to the receiver transceiver module 108 via a second vehicle data bus 122. In some examples, the second vehicle data bus 122 is implemented in accordance with the local interconnect network (LIN) protocol (as defined by ISO 17987 parts 1 through 7).

In the illustrated example, the body control module 110 includes an entry manager 124. The entry manager 124 wakes the LF transmitter 106 in response to receiving an unlatch request message 126 from one of the doors 114. The entry manager 124 receives the authentication message 120 from the receiver transceiver module 108. Based on the authentication token included in the authentication message 120, the entry manager 124 determines whether the key fob 104 that send the authentication message 120 is authorized to access the vehicle 102. Examples of determining whether the key fob is authorized are disclosed in U.S. patent application Ser. No. 15/278,971, entitled "Detection and Protection Against Jam Intercept and Replay Attacks," filed Sep. 28, 2016, which is herein incorporated by reference herein in its entirety. If the key fob 104 is authorized to access the vehicle 102, the entry manager 124 sends an unlatch authorization message 128 to the corresponding one of the doors 114. In some examples, the unlatch request message 126 and the unlatch authorization message 128 are communicated via signal lines 130*a* and 130*b*. In some such examples, the messages 126 and 128 are represented by voltage levels on the signal lines 130*a* and 130*b*. For example, the signal lines 130*a* and 130*b* may normally have a high voltage (e.g., 3.3V, 5V, etc.) when no message is to be communicated and switches to a low voltage (e.g., 0V, 1.2V, etc.) to communicate the corresponding message 126 and 128.

The body control module 110 receives commands to lock or unlock the door from (a) the key fob 104 via the receiver transceiver module 108, and/or (b) buttons on an interior console of the door 106. In response to receiving a command, the body control module 110 instructs the elatch 136 (e.g., via the data buses 112 and 142) to being a primary (e.g. locked) mode or in a secondary (e.g., unlocked) mode in accordance with the particular command.

In the illustrated example, the body control module 110 includes a processor or controller 132 and memory 134. The body control module 110 is structured to include entry manager 124. The processor or controller 132 may be any suitable processing device or set of processing devices such as, but not limited to: a microprocessor, a microcontroller-based platform, a suitable integrated circuit, one or more field programmable gate arrays (FPGAs), and/or one or more application-specific integrated circuits (ASICs). The memory 134 may be volatile memory (e.g., RAM, which can include non-volatile RAM, magnetic RAM, ferroelectric RAM, and any other suitable forms); non-volatile memory (e.g., disk memory, FLASH memory, EPROMs, EEPROMs, memristor-based non-volatile solid-state memory, etc.), and/or unalterable memory (e.g., EPROMs), etc. In some examples, the memory 134 includes multiple kinds of memory, particularly volatile memory and non-volatile memory.

The memory 134 is computer readable media on which one or more sets of instructions, such as the software for operating the methods of the present disclosure can be embedded. The instructions may embody one or more of the methods or logic as described herein. In a particular embodiment, the instructions may reside completely, or at least partially, within any one or more of the memory 134, the computer readable medium, and/or within the processor 132 during execution of the instructions.

The terms "non-transitory computer-readable medium" and "computer-readable medium" should be understood to include a single medium or multiple media, such as a centralized or distributed database, and/or associated caches and servers that store one or more sets of instructions. The terms "non-transitory computer-readable medium" and "computer-readable medium" also include any tangible medium that is capable of storing, encoding or carrying a set of instructions for execution by a processor or that cause a system to perform any one or more of the methods or operations disclosed herein. As used herein, the term "computer readable medium" is expressly defined to include any type of computer readable storage device and/or storage disk and to exclude propagating signals.

The first vehicle data bus 112 communicatively couples the body control module 110 to the doors 114. The first vehicle data bus 112 may be implemented in accordance with a controller area network (CAN) bus protocol as defined by International Standards Organization (ISO) 11898-1, a Media Oriented Systems Transport (MOST) bus protocol, a CAN flexible data (CAN-FD) bus protocol (ISO 11898-7), a K-line bus protocol (ISO 9141 and ISO 14230-1), and/or an Ethernet™ bus protocol IEEE 802.3 (2002 onwards), etc. In some examples, the first vehicle data bus 112 implements a different protocol than a door data bus (e.g., the door data bus 142 below). For example, the first vehicle data bus 112 may be implemented by protocol with a faster transmission rate than the door data bus. In such examples, the vehicle 102 includes the gateway module 116. The gateway module 116 converts messages sent via an initiating data bus (e.g., the first vehicle data bus 112 or the door data bus) into the format of the destination data bus.

The illustrated example depicts one door 114. However, the vehicle 102 may include any suitable number of doors 114 (e.g., two, four, etc.) that are connected to the body control module 110 via the first vehicle data bus 112 and the signal lines 130*a* and 130*b*. The doors 114 include an electronic latch (elatch) 136, a door control unit 138, a sensor 140, a door data bus 142 a window 144, and a exterior door handle 146.

The elatch 136 includes a latch assembly that is controlled by electrical actuators (e.g., solenoids, etc.) instead of mechanical linkage to the exterior door handle 146. The elatch 136 includes an electronic circuit (e.g., dicrete components, integrated circuits, a processor, etc.) to, for example, control the latch assembly and communicated via the door data bus 142. The elatch 136 is electrically coupled to the sensor 140. The sensor 140 detects when a user touches the exterior door handle 146. For example, the sensor 140 may be a capacitive sensor or an infrared sensor that detect movement behind the handle. When the elatch 136 detects the user via the sensor 140, the elatch 136 sends the unlatch request message 126 to the body control module 110. In response to receiving the unlatch authorization message 128 from the body control module, the elatch 136 sends a short drop request message 148 to the door control unit 138 via the door data bus 142. The elatch 136 unlatches in response to receiving a short drop complete message 150 from the door control unit 138. In some examples, when the in the secondary mode, the elatch 136 sends the sends a short drop request message 148 to the door control unit 138 in response to detecting the user touch the exterior door handle 146 instead of sending the unlatch request message 126 to the body control module 110. That is, in such examples, the elatch 136 does not unlatch request message 126 to determine whether the person is authorized to open the door 106. As a result, in such examples, even though the door 106 is "unlocked," the elatch 136 does not unlatch the door 106 until receiving the short drop complete message 150 from the door control module 138.

The door control unit 138 various functions related to the door 114. For example, door control unit 138 controls the position of the side view mirrors and the position of the window 144. The door control unit 138 includes an electronic circuit (e.g., dicrete components, integrated circuits, a processor, etc.) to, for example, control actuators to move the window 144 and communicated via the door data bus 142. The door control unit 138 is electrically coupled to inputs (e.g., toggles, switches, buttons, etc.) to control the window 144. Additionally, in response to the short drop request message 148 from the elatch 136, the door control unit 138 short drops the window 144. To short drop the window 144, the door control unit 138 lowers the window 144 so that the window 144 clears the channel in body or the convertible top of the vehicle 102. The distance the window 144 is dropped depends on the depth of the channel according to the specification of the particular vehicle 102. This distance is programmed into the door control unit 138 when the vehicle 102 is manufactured. After the short drop is finished, the door control unit 138 sends the short drop complete message 150 to the elatch 136. In such a manner, the door 114 of the vehicle 102 will not open until the window 144 has cleared the channel.

The door data bus 142 communicatively couples the elatch 136, the door control unit 138, and the body control module 110 (e.g., via the gateway module 116. The door data bus 142 may be implemented in accordance with the CAN bus protocol, the MOST bus protocol, the CAN-FD bus protocol, the K-line bus protocol, or the Ethernet™ bus protocol, etc. In some examples, the door data bus 142 is implemented by a slower bus (e.g., the CAN bus) than the first vehicle data bus 112 (e.g., the CAN-FD bus).

In operation, the elatch 136 sends the unlatch request message 126 to the body control module 110. In the illustrated examples, the elatch 136 sends the unlatch request message 126 via one of the signal lines 130*a*. Alternatively, in some examples, the elatch 136 sends the unlatch request message 126 via the data buses 112 and 142. The entry manager 124 of the body control module 110 wakes (e.g., drivers) the LF transmitter 106 to produce the beacon message 118. In response to detecting the beacon message 118, the key fob 104 transmits the authentication message 120 with an authentication token. The receiver transceiver module 108 receives the authentication message 120 and forwards the authentication message 120 to the entry manager 124 via the second vehicle data bus 122. The entry manager 124 determines whether the key fob 104 is authorized to access the vehicle 102 based on the authentication token in the authentication message 120.

If the key fob 104 is authorized to access the vehicle 102, the entry manager 124 sends the unlatch authorization message 128 to the elatch 136 of the door 114 that send the unlatch request message 126. In the illustrated example, the entry manager 124 sends the unlatch authorization message 128 via one of the signal lines 130*b*. Alternatively, in some examples, the entry manager 124 sends the unlatch authorization message 128 via the data buses 112 and 142. In some examples, after authorizing one door 114 to be unlatched within a time period (e.g., 15 seconds, 30 seconds, etc.), the entry manager 124 sends unlatch authorization messages 128 in response to subsequent unlatch request messages 126 received from the other doors 114 without causing the key fob 104 to send another authentication message 120. After receiving the unlatch authorization message 128, the elatch 136 sends the short drop request message 148 to the door control unit 138. The door control unit 138 lowers the window 144 to clear the channel in the body or the convertible top of the vehicle 102. When the window 144 is lowered, the door control unit 138 sends the short drop complete message 150 to the elatch 136 via the door data bus 142. In response to receiving the short drop complete message 150, the elatch 136 unlatches the door 114 facilitating the user opening the door 114.

The entry manager 124 instructs the door control module 138 (e.g., via the data buses 112 and 142) to close the window 144. In some examples, the entry manager 124 instructs the door control module 138 when the speed of the vehicle 102 is satisfies (e.g. is greater than) a threshold. In some such examples, the threshold is five miles per hour. Alternatively or additionally, in some examples, the entry manager 124 instructs the door control module 138 in response to receiving a command to lock the door 106.

Figure 2:
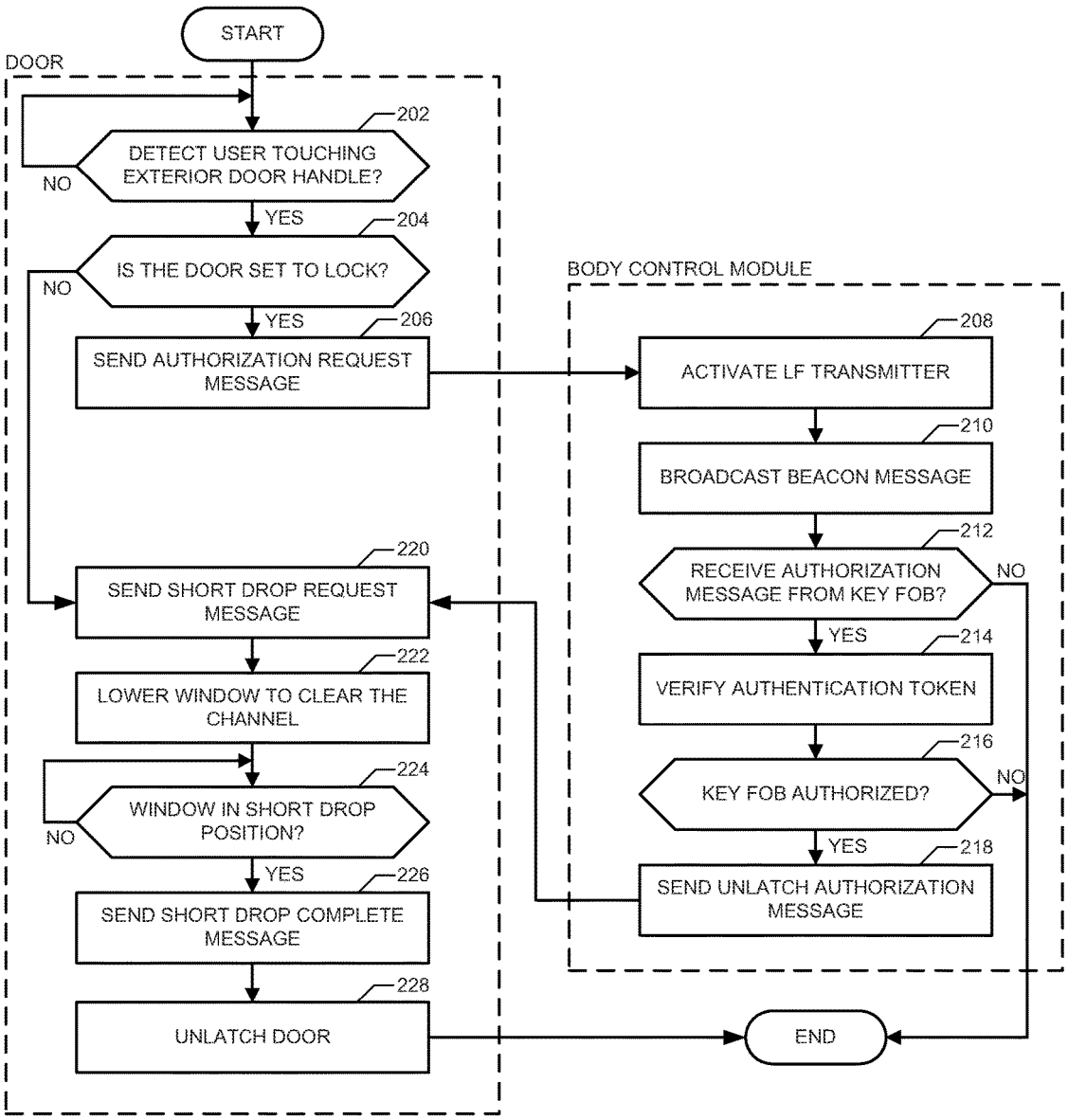
FIG. 2 is a flowchart of a method to short drop windows of the vehicle that may be implemented by the electronic components of FIG. 1.

FIG. 2 is a flowchart of a method to short drop windows 144 of the vehicle 102 that may be implemented by the electronic components 100 of FIG. 1. Initially, at block 202, the elatch 136 waits until it detects, via the sensor 140, that a user is touching the exterior door handle 146. At block 204, the elatch 136 determines whether it is set to a lock setting (e.g., by the entry manager 124 of the body control module 110). If the elatch 136 is set to a lock setting, the method continues at block 204. Otherwise, the elatch 136 is set to an unlock setting, the method continues at block 220. At block 206, the elatch 136 sends the unlatch request message 126 to the entry manager 124 of the body control module 110. At block 208, the entry manager activates the LF transmitter 106. At block 210, the LF transmitter broadcasts the beacon message 118.

At block 212, the entry manager determines whether the authentication message 120 has been received from the key fob 104. If the authentication message 120 has been received from the key fob 104, the method continues at block 214. Otherwise, if the authentication message 120 has not been received from the key fob 104, the method ends. At block 214, the entry manager 124 verifies the authentication token included in the authentication message 120. At block 216, the entry manager determines whether the key fob 104 is authorized based on the authentication token verified at block 212. If the key fob 104 is authorized, the method continues at block 218. If the key fob 104 is not authorized, the method ends. At block 218, the entry manager 124 sends the unlatch authorization message 128 to the elatch 136.

At block 220, the elatch 136 sends the short drop request message 148 to the door control unit 138. At block 222, the door control unit 138 lowers the window 144 to clear the channel of the body or the convertible top of the vehicle 102. At block 224, the door control unit 138 waits until the window 144 is in the short drop position. At block 226, the door control unit 138 sends the short drop complete message 150 to the elatch 136. At block 228, the elatch unlatches the door 114. The method then ends.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present instead of mutually exclusive alternatives. In other words, the conjunction "or" should be understood to include "and/or". The terms "includes," "including," and "include" are inclusive and have the same scope as "comprises," "comprising," and "comprise" respectively.

The above-described embodiments, and particularly any "preferred" embodiments, are possible examples of implementations and merely set forth for a clear understanding of the principles of the invention. Many variations and modifications may be made to the above-described embodiment(s) without substantially departing from the spirit and principles of the techniques described herein. All modifications are intended to be included herein within the scope of this disclosure and protected by the following claims.

What is claimed is:

1. A door of a vehicle comprising:
a door control unit; and
an electronic latch communicatively coupled to the door control unit, the electronic latch configured to:
in response to detecting a user touching an exterior handle, request authorization from the vehicle;
in response to receiving authorization, send a request to the door control unit to lower a window of the door; and
in response to receiving a confirmation from the door control unit, unlatch the door.

2. The door of claim 1, wherein the door control unit is configured to:
in response to receiving the request, lower the window; and
when the window is lowered to clear a channel defined by the vehicle, send the confirmation to the electronic latch.

3. The door of claim 1, including a sensor configured to detect when the user is touching the exterior handle.

4. The door of claim 1, wherein the electronic latch is electrically coupled to the exterior handle.

5. The door of claim 4, wherein the door does not include mechanical linkage between the electronic latch and the exterior handle.

6. The door of claim 1, wherein the electronic latch is communicatively coupled to the door control unit via a data bus.

7. The door of claim 6, wherein the data bus is in accordance to a controller area network (CAN) bus protocol.

8. A vehicle comprising:
a door including an electronic latch; and
a body control module communicatively coupled to the electronic latch; the body control module configured to:
broadcast a signal via a low frequency transmitter in response to receiving a request for authorization from the electronic latch, the signal to activate key fobs in a vicinity of the vehicle; and
responsive to one of the key fobs being authorized, grant the authorization to the electronic latch.

9. The vehicle of claim 8, the door further comprising a door control unit communicatively coupled to the electronic latch, and wherein the electronic latch is configured to:
in response to detecting a user touching an exterior handle, request the authorization from the body control module;
in response to receiving the authorization, send a request to the door control unit to lower a window of the door; and
in response to receiving a confirmation from the door control unit, unlatch the door.

10. The vehicle of claim 9, wherein the door control unit is configured to:
in response to receiving the request, lower the window; and
when the window is lowered to clear a channel defined by the vehicle, send the confirmation to the electronic latch.

11. The vehicle of claim 9, including a sensor configured to detect when the user is touching the exterior handle.

12. The vehicle of claim 9, wherein the electronic latch is electrically coupled to the exterior handle.

13. The vehicle of claim 12, wherein the door does not include mechanical linkage between the electronic latch and the exterior handle.

14. The vehicle of claim 9, wherein the electronic latch is communicatively coupled to the door control unit via a data bus.

15. The vehicle of claim 14, wherein the data bus is in accordance to a controller area network (CAN) bus protocol.

16. A method of operating a door of a vehicle comprising:
detecting a user touching an exterior handle, requesting, via an electronic circuit, authorization from the vehicle;
receiving authorization, sending, via the electronic circuit, a request to a door control unit to lower a window of the door; and
receiving a confirmation from the door control unit, unlatching the door.

* * * * *